US007422210B2

(12) United States Patent
Dejong et al.

(10) Patent No.: US 7,422,210 B2
(45) Date of Patent: Sep. 9, 2008

(54) SHEET DESKEWING SYSTEM WITH FINAL CORRECTION FROM TRAIL EDGE SENSING

(75) Inventors: Joannes N M Dejong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 575 days.

(21) Appl. No.: 11/072,794

(22) Filed: Mar. 4, 2005

(65) Prior Publication Data

US 2006/0208416 A1 Sep. 21, 2006

(51) Int. Cl.
*B65H 7/02* (2006.01)

(52) U.S. Cl. ..... 271/228; 271/227

(58) Field of Classification Search ..... 271/226–228, 271/261, 265.02, 265.03; 399/395; 400/579
See application file for complete search history.

(56) References Cited

U.S. PATENT DOCUMENTS

| | | | | |
|---|---|---|---|---|
| 4,971,304 | A | 11/1990 | Lofthus | |
| 5,169,140 | A | 12/1992 | Wenthe, Jr. | |
| 5,219,159 | A | 6/1993 | Malachowski et al. | |
| 5,278,624 | A | 1/1994 | Kamorath et al. | |
| 5,394,222 | A * | 2/1995 | Genovese | 399/167 |
| 5,794,176 | A | 8/1998 | Milillo | |
| 6,137,989 | A | 10/2000 | Quesnel | |
| 6,168,153 | B1 | 1/2001 | Richards et al. | |
| 6,276,586 | B1 * | 8/2001 | Yeo et al. | 226/17 |
| 6,374,075 | B1 * | 4/2002 | Benedict et al. | 399/395 |
| 6,533,268 | B2 | 3/2003 | Williams et al. | |
| 6,663,103 | B2 * | 12/2003 | Dobberstein et al. | 271/227 |
| 6,834,853 | B2 * | 12/2004 | Trovinger et al. | 271/227 |
| 6,988,725 | B2 * | 1/2006 | Rapkin | 271/227 |
| 2003/0000988 | A1 * | 1/2003 | Ruhland et al. | 226/20 |
| 2003/0146567 | A1 | 8/2003 | Williams et al. | |
| 2007/0040326 | A1 * | 2/2007 | Noda et al. | 271/227 |

* cited by examiner

*Primary Examiner*—Patrick Mackey
*Assistant Examiner*—Jeremy R Severson
(74) *Attorney, Agent, or Firm*—Fay Sharpe LLP

(57) ABSTRACT

In a system of automatic deskewing and registration of print media sheets moving in a printer paper path with laterally spaced apart differentially driven rollers controlled by the sensing of the moving sheet lead edge skew at a position downstream in said paper path there is further provided a subsequent trail edge sheet skew detection of the same moving sheet at a position upstream of the differentially driven rollers to subsequently differently control the differential driving of those same rollers to make a final and normally much smaller deskewing correction in the same sheet after the majority but less than all of said sheet is downstream of the differentially driven drive rollers.

3 Claims, 3 Drawing Sheets

SHEET DESKEWING SYSTEM WITH FINAL CORRECTION FROM TRAIL EDGE SENSING

Figure 1:
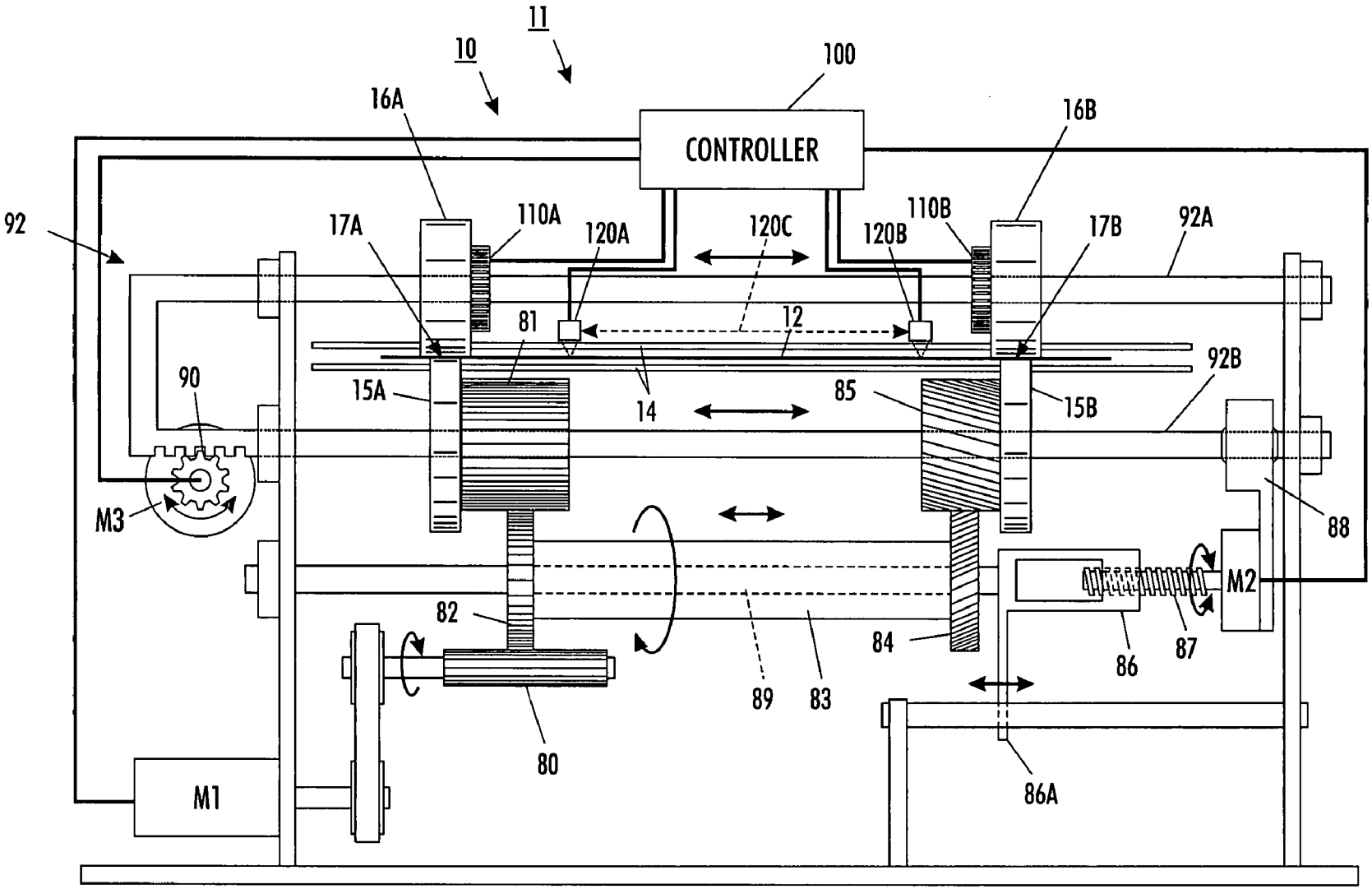

Cross-reference and incorporation by reference is made to a commonly assigned application, U.S. application Ser. No. 10/855,451, filed May 27, 2004, by David L. Knierim, et al, entitled "Print Media Registration Using Active Tracking of Idler Rotation".

Disclosed in the embodiment herein is an example of a printer with a print media sheet deskewing system in a paper path having laterally spaced apart differentially driven drive rollers and sheet lead edge skew detection sensors downstream in that paper path of these differentially driven drive rollers, and a deskew drive system controlled by the sheet lead edge sensors to substantially deskew and control the downstream motion of a moving sheet with those differentially driven drive rollers. Additionally disclosed herein is a sheet trail edge skew detection sensor system upstream of the differentially driven drive rollers and additionally connected to the deskew drive system to make a final and smaller deskewing sheet rotation correction in the same sheet after the majority but less than all of the sheet is downstream of the differentially driven drive rollers.

Examples of known such sheet deskewing systems with laterally spaced apart differentially driven drive rollers (with or without additional features of process direction and/or lateral (side) direction sheet registration), with names such as "AGILE" and "TELER," include the following U.S. patents, and others cited therein, all of which are incorporated by reference and need not be re-described herein: U.S. Patent Appln. Publication No. 20030146567 published Aug. 7, 2003; U.S. Pat. No. 4,971,304 by Lofthus, issued Nov. 20, 1990; U.S. Pat. No. 5,169,140 by Wenthe, Jr., issued Dec. 8, 1992; U.S. Pat. No. 5,219,159 by Malachowski et al, issued Jun. 15, 1993; U.S. Pat. No. 5,278,624 by Kamprath et al, issued Jan. 11, 1994; U.S. Pat. No. 5,794,176 by Milillo, issued Aug. 11, 1998; U.S. Pat. No. 6,137,989 by Quesnel, issued Oct. 24, 2000; U.S. Pat. No. 6,168,153 B1 by Richards et al, issued Jan. 2, 2001; U.S. Pat. No. 6,533,268 B2 by Williams et al, issued Mar. 18, 2003.

Col. 6, top, of the above-cited Milillo U.S. Pat. No. 5,794,176 suggests that "After the document is rotated, the same two sensors are used to detect the skew, if any, of the trailing edge of the turned document for correction of the velocity profile used to rotate subsequent documents." (Emphasis provided.)

On a different subject, the correction of process direction registration is known for second pass (second side) printing in xerographic duplex printing, especially where the paper original size may vary, or there may be size shrinking from fuser heating in the first side printing. This is because when a sheet is inverted for its second side printing the original lead edge is now the trailing edge. For example, the Xerox Corp. "Igen3" printer reportedly has a single trail edge sensor upstream of the differentially driven deskew rollers to detect correct process direction registration.

A specific feature of the embodiment disclosed herein is to provide a printer with a print media sheet deskewing system in a paper path having laterally spaced apart differentially driven drive rollers and a sheet lead edge skew detection sensor system in said paper path of said differentially driven drive rollers and a deskew drive system controlled by said sheet lead edge skew detector sensor system to substantially deskew and control the downstream motion of a moving sheet with said differentially driven drive rollers, further including a sheet trail edge skew detection sensor system upstream of said differentially driven drive rollers and additionally connected to said deskew drive system to make a final additional deskewing correction in the same sheet after a substantial portion but less than all of said sheet is downstream of said differentially driven drive rollers.

Further specific features disclosed in the embodiment herein, individually or in combination, include those wherein said sheet trail edge skew detection sensor system makes a final deskewing correction in the same sheet after the majority but less than all of said sheet is downstream of said differentially driven drive rollers; and/or wherein said sheet trail edge skew detection sensor system makes a final deskewing correction in the same sheet after all but the trailing end area of said sheet is downstream of said differentially driven drive rollers; and/or wherein said sheet trail edge skew detection sensor system for making a final deskewing correction in the same sheet comprises different trail edge sensors positioned at different distances upstream of said differentially driven drive rollers for trail edge detection of different sheet sizes; and/or wherein said sheet trail edge skew detection sensor system for making a final deskewing correction in the same sheet comprises at least one trail edge sensor which is repositionable at different distances upstream of said differentially driven drive rollers corresponding to different said sheet sizes for trail edge detection of said different sheet sizes; and/or wherein said sheet trail edge skew detection sensor system for making a final deskewing correction in the same sheet is connected to said deskew drive system to make a final deskewing correction in the same sheet which is smaller than said substantial deskewing controlled by said sheet lead edge skew detector sensor system; and/or wherein said sheet trail edge skew detection sensor system is additionally connected to said deskew drive system to provide trail edge information for compensating for small unintended variations in sheet size; and/or wherein said sheet trail edge skew detection sensor system is less than approximately 5 cm upstream of said differentially driven drive rollers and comprises at least two transversely spaced optical sensors in said paper path; and/or a method of printing print media sheets with automatic deskewing of a print media sheet while said sheets are moving in a paper path with laterally spaced apart differentially driven drive rollers controlled by the sensing of the moving sheet lead edge skew at a position in said paper path to control said differential driving of said rollers to deskew and control the downstream motion of the moving sheet, further including a subsequent trail edge skew detection of the same moving sheet at a position upstream of said differentially driven drive rollers subsequently controlling said differential driving of said rollers to make a final additional deskewing correction in the same sheet after a substantial portion but less than all of said sheet is downstream of said differentially driven drive rollers; and/or wherein said sheet trail edge skew detection sensor system makes a final deskewing correction in the same sheet after the majority but less than all of said sheet is downstream of said differentially driven drive rollers; and/or wherein said sheet trail edge skew detection sensor system makes a final deskewing correction in the same sheet after all but the trailing end area of said sheet is downstream of said differentially driven drive rollers; and/or wherein said sheet trail edge skew detection sensor system for making a final deskewing correction in the same sheet is connected to said deskew drive system to make a final deskewing correction in the same sheet which is smaller than said substantial deskewing controlled by said sheet lead edge skew detector sensor system; and/or wherein said sheet trail edge skew detection sensor system additionally provides trail edge information for compensating for small unintended variations in sheet size; and/or wherein said sheet trail edge skew detection sensor system for making a final deskewing correction in the same sheet comprises different trail edge sensors positioned at different distances upstream of said differentially driven drive rollers which are differently selected for trail edge detection of different sheet sizes.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. The term "process direction" means the normal movement direction of the print media through the printer along what is called the "paper path."

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
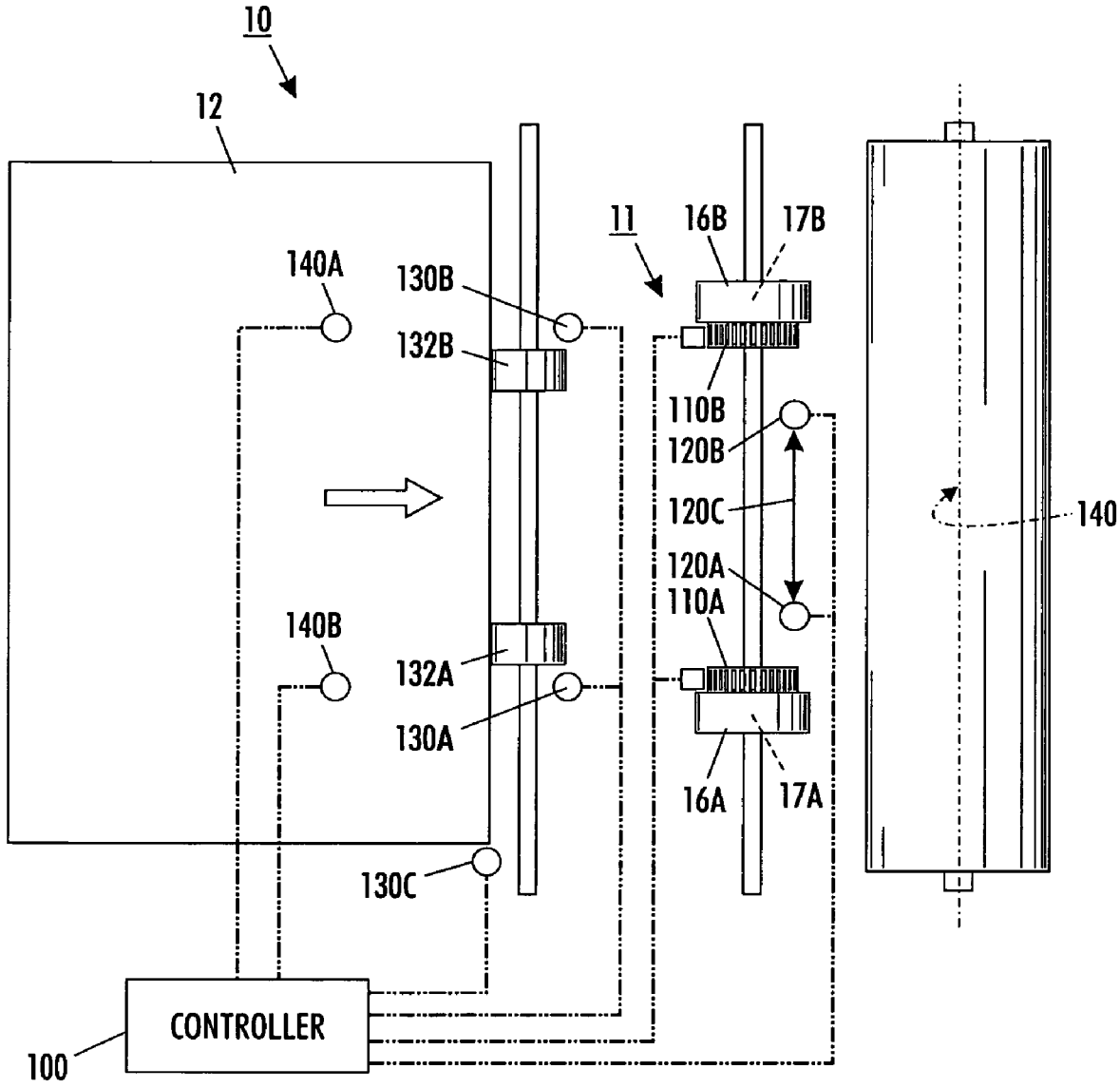
Figure 3:
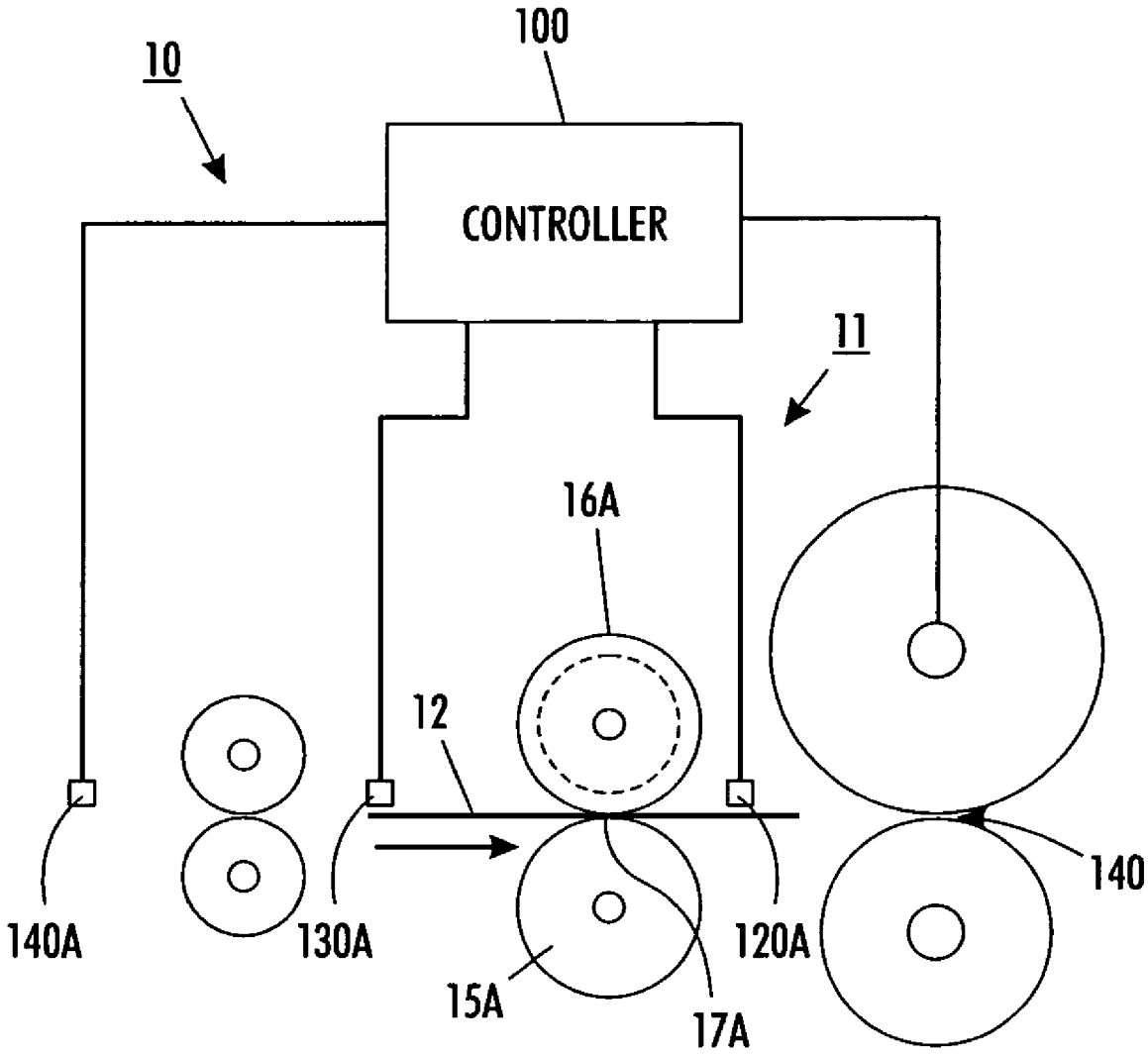

Various of the above-mentioned and further features and advantages will be apparent to those skilled in the art from the specific apparatus and its operation or methods described in the example below, and the claims. This description of a specific embodiment includes the drawing figures (which are approximately to scale other than as schematicised) wherein:

FIG. 1 is from the above cross-referenced co-pending commonly owned U.S. application Ser. No. 10/855,451 for illustrating in a view transverse the paper path one recent example of a sheet deskewing and registration system with differentially driven drive rollers which may be modified as in the example of FIGS. 2 and 3 for improved accuracy;

FIG. 2 is a schematic simplified top view of the sheet deskewing and registration system of FIG. 1 showing the additional sheet trail edge skew detection sensor system upstream of the differentially driven drive rollers and additionally connected to the same deskew drive system to make a final and smaller deskewing sheet rotation correction in the sheet; and FIG. 3 is a side view of the schematic view of FIG. 2.

Describing now in further detail the exemplary embodiment with reference to the Figures, there is shown only a portion of the paper path of what may be an otherwise conventional reproduction machine or printer 10, with one example, shown in more detail in FIG. 1, of a sheet deskewing and registration system 11, in this example a "TELER" system. Since this "TELER" system 11 is similar to the above described references thereon, especially U.S. Patent Appln. Publication No. 20030146567 published Aug. 7, 2003 and U.S. Pat. No. 6,533,268 B2, incorporated by reference herein, it need not be re-described in detail herein. Thus, briefly describing this FIG. 1 example, the differentially driven spaced apart frictional drive rollers 15A and 15B provide for deskewing and registering the sheet 12 in their nips 17A, 17B formed with mating idlers 16A, 16B. This particular deskewing and registration system 11 can additionally provide both process direction and transverse direction sheet registration movement correction. Via programmed controller 100, signaled by sheet lead edge sensors 120A, 120B (transversely spaced distance 120C apart), motor 1 via gears 80, 82, 81, tube 83 and gear 84 rotates the drive rollers 15A and 15B at the acceleration or deceleration profile for process direction registration of the sheet 12 in the nips 17A, 17B. Motor M3 via gear 80 and "U" shaped member 92 with arms 92A, 92B provides transverse movement of the sheet 12 within its baffles 14. Motor M2 drives translation system 87, 86, 86A, 88 and shaft 89 to move helical gears 84,85 laterally relative to one another to cause desired differential rotation of drive roller 15B relative to 15A to rotate for deskewing the sheet 12. An additional optional feature, further described in the above cross-referenced copending commonly assigned U.S. application Ser. No. 10/855,451, filed May 27, 2004, is the idler rollers 16A, 16B velocity measurement system 110A, 110B.

In operation, shortly after the sheet 12 arrives at and its lead edge area passes through the nips 17A, 17B, the lead edge sensors 120A and 120B at that position measure with the controller 100 program the sheet process direction error and/or skew error. The respective velocities of the two nips are then prescribed a movement profile to correct for those detected skew and/or process errors. However, as noted below, such sheet deskew and/or registration position errors as may occur after the measurement at lead edge sensors 120A and 120B that are not thereby fully corrected by the system 11, including any deformation or slippage errors in the two drive rolles 15A, 15B, or controller 100 calculation errors, or over-corrections, will not show up or be corrected thereby.

Thus, turning now to the simplified schematic top view of FIG. 2 and side view of FIG. 3, it may be seen that sheet 12 trailing edge laterally spaced sensors (detectors) 130A and 130B upstream of the system 11 correction nips 17A, 17B are provided in addition to the sheet lead edge sensors 120A, 120B downstream of the correction nips 17A, 17B. These trail edge upstream sensors also connected to the controller 100, for advantages, which will be further described.

The simplified schematic top view of FIG. 2 and side view of FIG. 3 additionally illustrates a downstream image transfer nip 140 for the exemplary printer 10, which for drawing convenience is not to scale. Also this image transfer nip 140 is not shown in as far downstream in position along the printer 10 paper path as would normally be provided for a system 11 capable of handling a large range of different sheet sizes. An additional optional sheet side edge position sensor 130C is also shown in FIG. 2.

By way of further background explanation of this embodiment, as noted above and shown in the cited and other art, existing sheet registration systems may desirably use a pair of independently controlled sheet feeding nips formed by idlers mating with driven elastomeric sheet feeding rollers to sequentially individually deskew (rotate) the sheet and register the sheet in the process direction (slowing down or speeding up the sheet). After the sheet has entered these nips, a set of sensors measures the skew and/or process direction positional error of the sheet lead edge, and separate velocity profiles may be commanded to each nip to compensate for the process and/or skew errors. This open loop control method is effective for most such errors but does not fully compensate for any errors that are induced after the initial sheet edge measurements are taken from the lead edge of the sheet (at the beginning of the drive profile) while the positional corrections are being made on the sheet by the differentially driven drive nips. As shown by the above cited references, the sheet position correction process itself can involve variable velocities and even varying acceleration and deceleration driving forces between the respective independently driven drive rollers and the sheet.

The disclosed system and method additionally uses the trailing edge of the same sheet to re-measure and do a fine final correction of the skew and/or process error after the above open loop correction is otherwise completed but while the trailing end of the sheet is still in the correction nips. Sheet trailing edge measurement sensors are located a sufficient distance upstream of the correction nips to provide for this, for example about 5 cm upstream of the nips. After the trail edge of the sheet passes these upstream sensors, a final fine small process and/or skew registration move may be executed by the same nips via the same control and differential drive system. This can compensate for any errors that occurred during the open loop initial or gross correction process. Various suitable corrective velocity drive profiles for skew and/or process registration driving of the corrective nips are known and need not be re-described herein.

Here, the sensors 130A and 130B are upstream of the registration nips. When the trail edge of the sheet arrives at those sensors, any skew and/or process direction errors remaining after the initial skew and process direction registration can be measured and the velocities of the two correction nips 17A, 17B re-profiled for that final corrective compensation. This second, additional, and normally much smaller correction does not preclude or interfere with the prior normal open loop correction, or require a different initial open loop correction profile to be executed.

Instead of separate upstream and downstream sensor sets, as shown in this example, it may be possible for the downstream sensor set to have two positions and a movement system so that it could moved to the upstream trail edge detection location before the sheet leaves the correction nips, and then moved back to its initial position after detecting the sheet trailing edge profile. Also, the upstream trail edge sensor or sensors may be movable, for example to be automatically moved in operating position to a different distance upstream of said differentially driven drive rollers for trail edge detection of different sheet sizes in response to sensing different size sheets.

Alternatively in FIGS. 2 and 3 there is shown an optional additional set of upstream sheet trail edge sensors 140A and 140B optionally used for the sheet trail edge skew detection sensor system for making a final deskewing correction in the same sheet. These trail edge sensors 140A and 140B are positioned at a different distance upstream of the differentially driven drive rollers than the trail edge sensors 130A and 130B for use for trail edge detection of different sheet sizes.

The trail edge sensors 130A and 130B (and/or 140A and 140B) may optionally provide a second or dual mode function of providing trail edge information for compensation for the small variations in sheet size between sheets fed from the same stack or due to sheet size shrinkage in sheets that were printed on one side and thermally fused and are being fed back through the same sheet deskewing and registration sheet path for their second side (duplex) printing. That is, compensating for small unintended variations in sheet size.

As taught in the above-cited U.S. Pat. No. 6,168,153 B1, for example, especially for larger sheets, the regular upstream sheet feeding nips (as shown for example by 132A and 132B in FIG. 2) normally feeding the sheet downstream in the printer paper path may need to be solenoid and/or cam operated to open and close in order to be able release the sheet 12 at the appropriate times to free the sheet 12 to allow the corrective nips 17A, 17B to make the corrective movements of a sheet in those nips.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A printer with a print media sheet deskewing system in a paper path comprising:

laterally spaced apart differentially driven drive rollers and a sheet lead edge and trailing edge deskew detection sensor system in said paper path of said differentially driven drive rollers, and said deskew drive system controlled by said sheet lead edge skew detector sensor system positioned downstream of said differentially driven drive rollers to deskew and control the downstream motion of a moving sheet with said differentially driven rollers, further including said sheet trail edge skew detection sensor system comprising at least two transversely spaced optical sensors in said paper path and positioned upstream of said differentially driven drive rollers, said trail edge skew detection sensor system connected to said deskew drive system to make a final additional deskewing correction in the same sheet after a substantial portion but less than all of said sheet is downstream of said differentially driven drive rollers, wherein said sheet trail edge skew detection sensor system makes a final deskewing correction in the same sheet after less than all of said sheet is downstream of said differentially driven drive rollers, wherein said sheet trail edge skew detection sensor system for making a final deskewing correction in the same sheet comprises different trail edge sensors positioned at different distances upstream of said differentially driven drive rollers for trail edge detection of different sheet sizes.

2. The printer of claim 1, wherein said sheet trail edge skew detection sensor system is less than approximately 5 cm upstream of said differentially driven drive rollers and comprises at least two transversely spaced optical sensors in said paper path.

3. The printer of claim 1, wherein said sheet trail edge skew detection sensor system for making a final deskewing correction in the same sheet is connected to said deskew drive system to make a final deskewing correction in the same sheet which is smaller than said substantial deskewing controlled by said sheet lead edge skew detector sensor system.

* * * * *